US008434241B2

(12) United States Patent
Lehmann et al.

(10) Patent No.: US 8,434,241 B2
(45) Date of Patent: May 7, 2013

(54) METHOD FOR DRYING A WET MATERIAL

(75) Inventors: Markus Lehmann, Wohlen (CH); Markus Braendli, Erlinsbach (CH)

(73) Assignee: Markus Lehmann, Wohlen (CH)

( * ) Notice: Subject to any disclaimer, the term of this patent is extended or adjusted under 35 U.S.C. 154(b) by 682 days.

(21) Appl. No.: 12/594,000

(22) PCT Filed: Apr. 1, 2008

(86) PCT No.: PCT/CH2008/000144

§ 371 (c)(1),
(2), (4) Date: Sep. 30, 2009

(87) PCT Pub. No.: WO2008/122137

PCT Pub. Date: Oct. 16, 2008

(65) Prior Publication Data

US 2010/0115789 A1 May 13, 2010

(51) Int. Cl.

| | |
|---|---|
| ***F26B 5/04*** | (2006.01) |
| ***F26B 21/06*** | (2006.01) |
| ***F26B 3/00*** | (2006.01) |

(52) U.S. Cl.

USPC ..... 34/402; 34/558; 34/470; 34/538

(58) Field of Classification Search ..... 34/470, 34/514, 538, 558, 402

See application file for complete search history.

(56) References Cited

U.S. PATENT DOCUMENTS

| | | | | |
|---|---|---|---|---|
| 4,153,411 | A | 5/1979 | Isheim | |
| 4,241,043 | A | 12/1980 | Hetzel | |
| 5,490,907 | A | 2/1996 | Weinwurm et al. | |
| 5,810,975 | A | 9/1998 | Bourdel | |
| 6,971,187 | B1 * | 12/2005 | Pikal et al. | 34/285 |
| 2004/0115090 | A1 * | 6/2004 | Andersson et al. | 422/1 |
| 2006/0000108 | A1 | 1/2006 | Cho et al. | |

FOREIGN PATENT DOCUMENTS

| | | |
|---|---|---|
| DE | 19822355 | 11/1999 |
| DE | 100006036 | 8/2000 |
| EP | 0379657 | 8/1990 |
| FR | 1254139 | 4/1960 |
| GB | 1265719 | 3/1972 |
| GB | 2052708 | 1/1981 |
| WO | 02/09837 | 2/2002 |
| WO | WO 2006/033718 | 3/2006 |

OTHER PUBLICATIONS

English translation of International Preliminary Examination Report on Patentability, issued Nov. 10, 2009.

* cited by examiner

*Primary Examiner* — Kenneth Rinehart
*Assistant Examiner* — John McCormack
(74) *Attorney, Agent, or Firm* — Dority & Manning, P.A.

(57) ABSTRACT

A method for drying a wet material, which comprises a liquid Fd to be distilled, uses a gas-tight container system resistant to excess and/or negative pressure and a drying container, a condenser and a vapor chamber connecting the drying container and condenser. The temperature adjustable drying container contains the wet material. The liquid Fd is turned to vapor in the temperature adjustable vapor chamber. The condenser condenses the vapor to give the condensation product. The pressure in the vapor chamber is monitored and controlled so that drying and distillation are always carried out in a range close to the saturation vapor pressure of the liquid Fd to be distilled. The pressure and the temperature in the vapor chamber are continuously determined. If the pressure goes above the upper limit of the range, the pressure is reduced in such a manner that especially foreign gas is removed.

37 Claims, 3 Drawing Sheets

METHOD FOR DRYING A WET MATERIAL

CROSS-REFERENCE TO RELATED APPLICATIONS

This application claims priority to International Application Serial No. PCT/CH2008/000144 filed Apr. 1, 2008, which claims priority to Swiss Application No. CH 5481/07 filed Apr. 4, 2007.

TECHNICAL FIELD

The invention relates to a method for drying a pasty wet material, in particular sludge, using a gas-tight container system that is resistant to excess and/or negative pressure. The container system comprises a drying container with the wet material, the temperature of which can be adjusted, a condenser for condensing vapor into liquid to yield the condensate as well as a vapor chamber connecting the drying container and the condenser.

BACKGROUND

Drying installations for sludge, in particular sewage sludge are known. With such installations, the sludge to be dried is pre-dried in a preliminary stage with centrifuges until the sludge has a dry solids TS content of about 20 to 40%. Said starting material is pasty and very sticky, which complicates the handling. Now, said wet material may be burnt in an incinerator with high costs. This is accomplished at about 400° C. and is not desirable since by said method often hazardous substances, such as heavy metals are released.

A further alternative for drying the pasty starting material is the use of a so-called fluid-bed dryer which dries the mass under continuous admixing by using a hot air blower. Such installations have the disadvantages of severe sticking at the surfaces of installation parts as well as a severe odor emission into the adjacent environment whereby the quality of living is severely limited.

OBJECTS AND SUMMARY OF THE INVENTION

The object of the present invention is to provide a low-energy method for drying a wet material, which does not harm the environment with odor emissions or toxic materials.

The object is solved by a method described below.

The idea underlying the present invention resides in that except for a small tolerated residual amount, the vapor in the vapor chamber is free from foreign gas. This is achieved by monitoring and controlling the pressure in the vapor chamber in such a manner, that the drying is always carried out in the range near the saturation vapor pressure of the liquid to be distilled. For this purpose pressure and temperature in the vapor chamber have to be continuously monitored. In the case of an excessive pressure it is reduced in such a manner that primarily foreign gas is removed. This promotes the efficiency of the condenser and thus the performance of the drying installation with a lower energy expenditure. Furthermore, the temperature difference between drying container and condenser may be kept small.

Further advantageous embodiments are obvious from the dependent claims.

SHORT DESCRIPTION OF THE DRAWINGS

In the following the invention is illustrated in more detail with respect to the drawings.

DETAILED DESCRIPTION OF EXEMPLARY EMBODIMENTS

Figure 1:
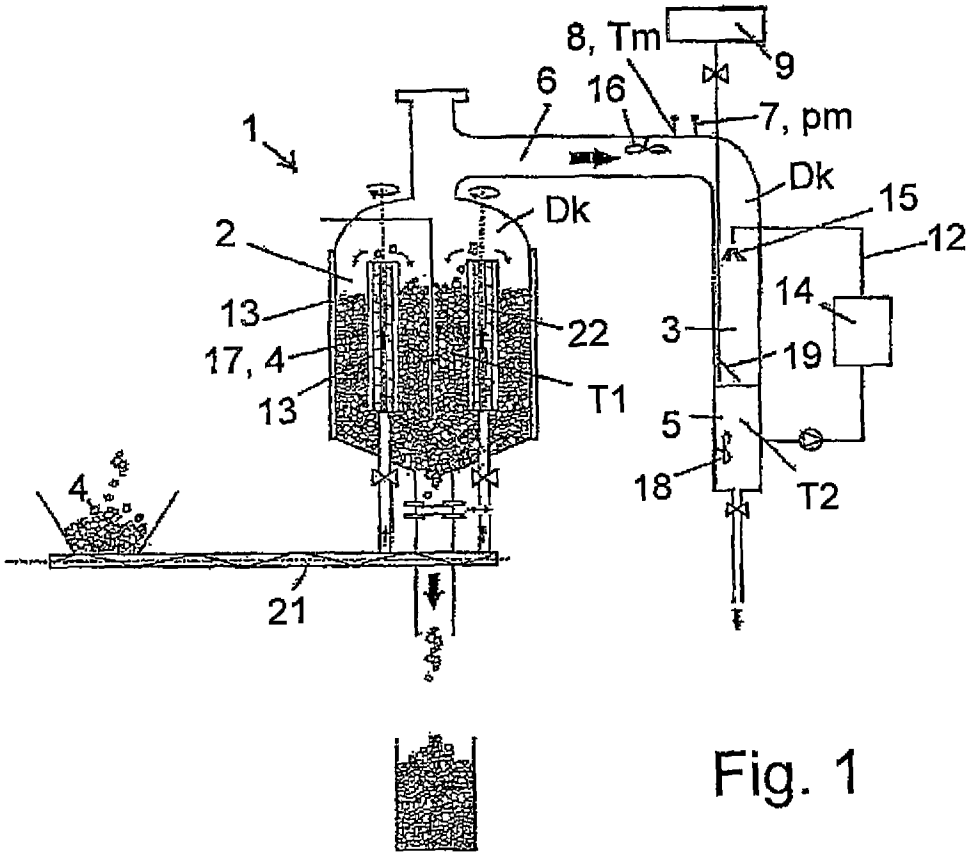
FIG. 1 shows a schematic illustration of a drying installation of the present invention.

FIG. 1 shows a simple embodiment of a drying installation of the present invention. It comprises a container system 1, which is divided into the regions of drying container 2, condenser 3 and vapor chamber 6, wherein the container system 1 has to be resistant to excessive and/or negative pressure. In drying container 2 is the wet material 4, which comprises the liquid to be distilled Fd and the temperature of which may be adjusted. The condenser 3 accommodates the condensate 5, the temperature of which may also be adjusted and which is generated by distillation following condensation. The temperature of the wet material 4 as well as of the condensate 5 may also be adjusted outside of the container system 1.

The vapor chamber 6 connects the drying container 2 with the condenser 3. It is filled with the vapor to be condensed Dk. Said vapor Dk was generated by evaporation of the liquid Fd to be distilled from the drying container 2. The vapor chamber 6 is provided with a pressure sensor 7 for measuring the mixed pressure pm adjusted in the vapor chamber 6, with a temperature sensor 8 for measuring the mixed temperature Tm adjusted in the vapor chamber 6, as well as with a pressure regulator 9 for adjusting, in particular reducing, the mixed pressure pm in the vapor chamber 6.

For carrying out the drying, the drying container 2 with the wet material 4 is first brought to a first temperature T1 and the condenser 3 to a second lower temperature T2. Subsequently, the mixed pressure pm and the mixed temperature Tm are measured. From the measured mixed temperature Tm, the saturation vapor pressure ps of the liquid Fd having the temperature Tm can be determined.

The saturation vapor pressure is a characteristic of a liquid. It describes the vapor pressure which is maximal at a specific temperature and is often abbreviated as vapor pressure. For example, from pure liquids atoms/molecules escape into the gas phase until a pressure is established which is dependent from the material type and the equilibrium temperature. Said pressure is the saturation vapor pressure. Said pressure prevails when the gas is in a thermodynamic equilibrium with the liquid. In this state, the evaporation of the liquid quantitatively equals the condensation of the gas. At the bottom line, none of the phases grows at the expense of the other, whereby both may simultaneously exist in a stable manner. This is also referred to as a dynamic equilibrium.

Figure 3:
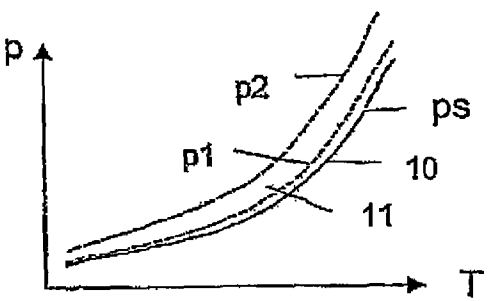
FIG. 3 shows a pressure vs. temperature graph with the saturation vapor pressure of the liquid to be evaporated.

In FIG. 3, an example of a saturation pressure curve 10 of a material is provided as a function of a pressure vs. the temperature, wherein the liquid phase of the material is present in the left top region and the gaseous phase in the right bottom region of the curve. The phase change takes place in the region of the saturation vapor pressure curve 10. Saturation vapor pressure curves of common materials are known and can be looked up in manuals or may be interpolated via formulae.

Following the determination of the saturation vapor pressure ps, a set pressure range 11 is calculated. Preferably, the mixed pressure pm in the vapor chamber 6 should be in this set pressure range 11 at the corresponding mixed temperature Tm, so that the distillation and thus the drying is done in an optimal manner, i. e. with as little energy and as efficient as possible.

Figure 2:
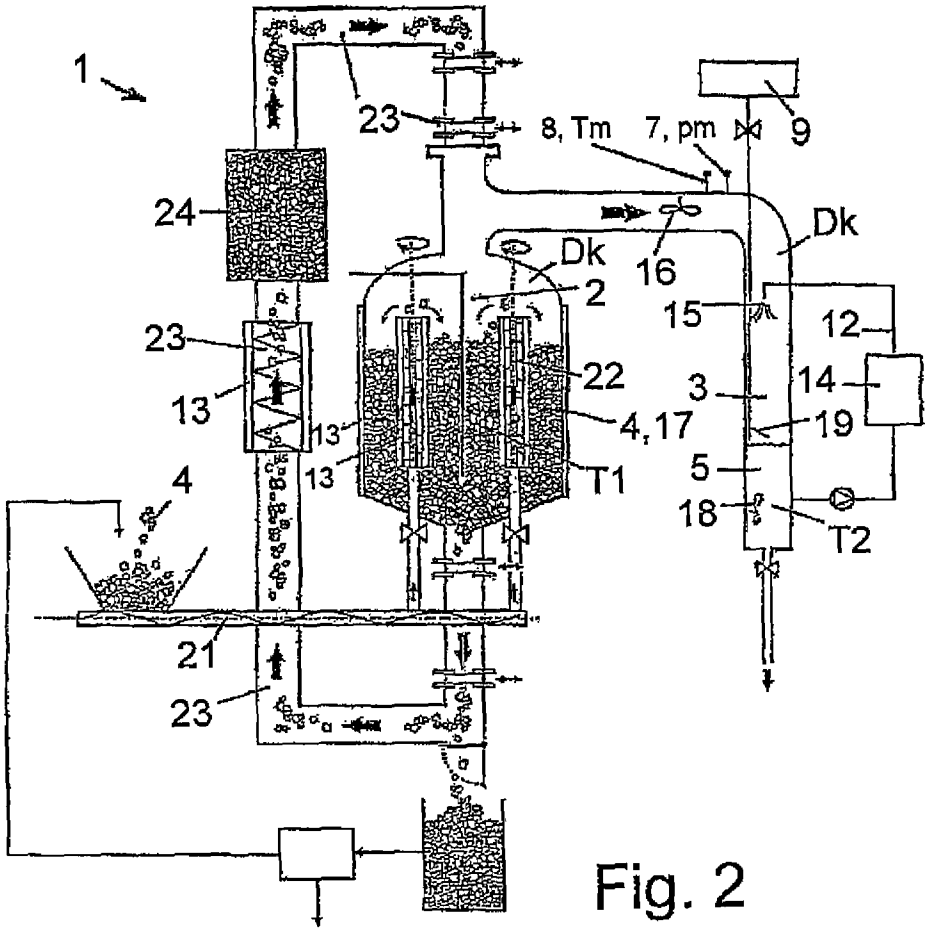
FIG. 2 shows a further schematic illustration of a drying installation of the present invention.

The set pressure range 11 is above the saturation vapor pressure curve since it includes the quantity of pressure-increasing foreign gas. It is limited by a lower pressure limit p1 and an upper pressure limit p2, such as is illustrated in FIG. 2. The lower pressure limit p1 is at least 0.1% above the saturation vapor pressure ps and the upper pressure limit p2 is at the most 6% above the saturation vapor pressure ps.

Initially, the mixed pressure pm is compared with the set pressure range 11. At the beginning of the process the mixed pressure is far above the set pressure range 11. In this case the mixed pressure pm is reduced by pressure regulator 9 exactly until it has reached the lower pressure limit p1. Preferably, this is done with the pressure regulator 9 which may be a pump. As soon as the pressure limit p1 has been reached, the pressure regulator 9 is stopped.

Now, the distillation and thus the drying continue autonomously as long as the wet material 4 in the drying container 2 has a temperature T1 which is higher than the mixed temperature Tm. Since the gas tends to be in a thermodynamic equilibrium with the liquid, the evaporation of the liquid to be distilled Fd is promoted. Since again a thermodynamic equilibrium is aspired, the condensation is promoted as long as the temperature T2 of the condenser is lower than the mixed temperature Tm.

As long as the mixed pressure pm does not exceed the pressure limit p2, the intended mixed pressure which is optimal for the process is automatically established without intervention of the pressure regulator 9 also with changes of the temperature of the medium to be evaporated or to be condensed.

During the operation of the drying, the mixed temperature Tm and the mixed pressure pm are continuously monitored until the mixed pressure pm has reached the upper pressure limit p2. The pressure may increase since e.g. the container system 1 or another component of the installation exhibit a small leakage, whereby foreign gas may be introduced into the vapor chamber 6 or since foreign gases may have been released from other materials of the installation or from the wet material 4. As soon as the mixed pressure pm has reached or exceeded the upper pressure limit p2, the pressure in the vapor chamber 6 is again reduced by starting the pressure regulator or the pump 9, respectively. As soon as the mixed pressure pm has reached the lower pressure limit p1, the pressure regulator 9 may be stopped again. Now, the drying again is carried out with optimal parameters. Said procedures may be continued as long as wet material 4 can be fed and condensate 5 can be discharged.

The quality of the condensation significantly depends on the foreign gas proportion. A foreign gas proportion in the vapor chamber with a partial vapor pressure of a few per mils may already reduce the condensation by 20 to 50%. Thus, the mixed pressure is continuously monitored and compared with the set pressure range 11.

The foreign gas accumulates at the end of the condensation pathway, since it is flushed by the gas flow flowing from wet material 4 through the vapor chamber 6 to the condensate 5, but finally cannot condensate. Therefore, it is advantageous to suck off the vapor at the end of the condensation pathway in the condenser 3 directly at the condensate 5. Thus, in the course of reducing the mixed pressure pm the highest concentration of foreign gas can be removed from the container system 1. On the other hand, it has to be insured, that the condensate dropping down does not get directly into the intake flow of the pressure regulator or the pump 9, respectively. This may be achieved by a protection panel 19.

The set pressure range 11 should not be too close to the saturation vapor pressure curve 10, since otherwise during the reduction of the mixed pressure pm an excess of the vapor to be condensed Dk is sucked off by pump 9. It has proven advantageous to select the lower pressure limit p1 preferably at least 0.2% and the upper pressure limit p2 preferably at most 4% above the saturation vapor pressure ps.

In contrast to conventional methods, the method according to the present invention continuously monitors the prevailing mixed pressure pm in vapor chamber 6 and compares it with the set pressure range 11, to appropriately control the mixed pressure pm if necessary. Mostly, conventional methods continuously suck off gas from the vapor chamber, whereby on the one hand a high amount of energy has to be spent and on the other hand a high amount of the energetically useful condensate is unnecessarily removed from the vapor chamber. In contrast, the present method most of the time works without any vacuum pump, since it has to be switched on only temporarily and only for a short time.

The temperature difference T1−T2 between drying container 2 and condenser 3 may be selected particularly small with this method according to the invention and is preferably between 1 degree K and 10 degrees K, ideally between 1 degree K and 3 degrees K. This is an enormous energetic advantage, since thus only little energy has to be spent for generating the temperature difference.

The drying and/or the condensation may be promoted by enlarging the surfaces of the wet material 4 in the drying container 2 and/or the surface of the condensate 5 in the condenser 3. For example, a surface enlargement may be achieved by fine spraying the condensate 5. A fine die arranged for this purpose of a spraying unit 15 in the condenser 3 can generate a surface of several square meters in every second, at which surface the vapor to be condensed Dk may condense. Advantageously, the spraying is arranged in a particular direction, so that an optimal mixing of the vapor in vapor chamber 6 is achieved. This is important to achieve an as high as possible heat transfer between wet material 4 and the vapor in vapor chamber 6. Thereby, the efficiency is promoted and the mixed temperature Tm may be determined in a reliable manner. Otherwise or additionally, a ventilator 16 may be arranged in the vapor chamber 6 to achieve the desired mixing of the vapor. A heating unit 13 in the region of the drying container 2 and a cooling unit 14 in the region of feed lines 12 from the spraying unit 15 on the side of condenser 3 provide the achievement of the set temperatures T1 and T2 in drying container 2 and in condenser 3. Of course, the temperature regulating units 13 and 14 may also be directly arranged in wet material 4 and in condensate 5.

The surface enlargement may also be achieved by introducing a surface enlarging porous filling package into the condenser 3. These enable a maximum temperature equalization between mixed vapor and the condensate.

The surface enlargement of the wet material 4 in drying container 2 may be achieved by mixing wet material 4 under a granular carrier 17. Said carrier 17 accommodates a portion of the liquid of wet material 4, which thereby becomes drier and thus less sticky. This is important, since the stickiness of the wet material 4 used herein generally is so high that it deposits on all surfaces of the installation and even makes a cleaning nearly impossible. Said carrier 17 may consist of the dry substance TS which is included in the pasty wet material 4. This has the advantage that during withdrawal the dry material has not to be separated any longer.

Advantageously, the carrier 17 consists of an abrasive material, in particular woodchips, plastic granulate or pebble-like stones. Thereby, all surfaces of the installation are continuously cleaned. Often, the dry material TS itself is already abrasive. For this reason, the use of a foreign material for carrier 17 is not mandatory. A core size between 0.5 and 30 mm has turned out to be suitable.

Preferably, carrier 17 is mixed with the wet material 4 in a pre-heated condition. Said pre-heating may be carried out inside or outside of the drying container 2.

According to the present invention, the mixing of carrier 17 and wet material 4 with the optimal amount of energy is e.g. carried out as follows. The drying container 2 has a heating unit 13 in its casing and is filled with carrier 17, which may be the dry material and which may be brought to the desired temperature. With a conveying system 21, the wet material 4 is fed and introduced into drying container 2 in another conveying system 21. Finally, one or more conveying screws or in particular heating screw conveyors 22 continuously mix some wet material 4 under carrier 17 which is present in a large amount. In the screw, mixing and combination occur until the mixture with a lower wet proportion is ejected into drying container 2. The temperature and pressure ratios now promote the drying whereby the mixture dries very fast. In order to optimize the method with respect to the energy expenditure, the thermal energy introduced in carrier 17 should correspond to the energy which is required for drying the wet material 4. The surveillance of the cooling curve prevents a wetting. Otherwise, the energy which has not been used remains stored in carrier 17.

Since the dry proportion only is about 20-40% of the introduced wet material 4, a large amount of wet material 4 may be introduced until the drying container 2 is full, because liquid Fd is brought into condenser 3. A portion of the contents is removed from drying container 2 in intervals. Correspondingly, the drying container 2 may also be filled in intervals. The removed content is subsequently separated into dry material TS and carrier 17, in the case they are not the same materials. Subsequently, a sorting installation may sort the dry material TS into recyclable and non-recyclable masses, e.g. due to the particle size. A portion of the dry material TS or specifically separated material, e.g. dust may subsequently be admixed into the wet starting material again. Following withdrawal, the carrier 17 may also be introduced into the system again.

The process may run in a continuous operation, such as is illustrated in FIG. 2. Dry content from drying container 2 is fed through a conveying and locking system 23 and thereby externally brought to the desired temperature by using a heating unit 13. Since said material is dry, no evaporation occurs by the heating thereof. In a storage container 24 said material may be stored until it is employed. If required, it is again added to the drying container 2 by means of the conveying and locking system 23. For example, this is the case when the temperature in drying container 2 is too low. By said system having conveying and locking systems 23 additionally or alternatively to the internal heating of the drying container an external heating may be applied.

A large advantage of the installation described and of the method described resides in that during heating of the dry material heat may be introduced which may be used for drying not only immediately but also at a later time. Thus, heat may be introduced for drying round the clock, which results in a higher drying productivity in comparison to processes which are dependent on the presence of staff or which underlie limited drying periods. The described process, which is conducted on the described installation may further quickly react to variations of the sludge composition (water content, stickiness), the heating temperature and the heating capacity without losses of the drying quality, since the relevant parameters only are the temperature difference T1−T2 between drying container 2 and the condenser 3 and the stored thermal energy.

A further huge advantage of the installation described and the process described resides in that the entire process does not cause any odor emission, since the circuits are closed. Solely, if the vacuum pump 9 is running some odor is released. However, this is out of all proportion to an installation as is described in the prior art. On the hand, the gases have been already washed and contain little odorous substances, on the other hand, the released amounts are very small. In the proximity of such an installation no unpleasant odor may be sensed.

Figure 4:
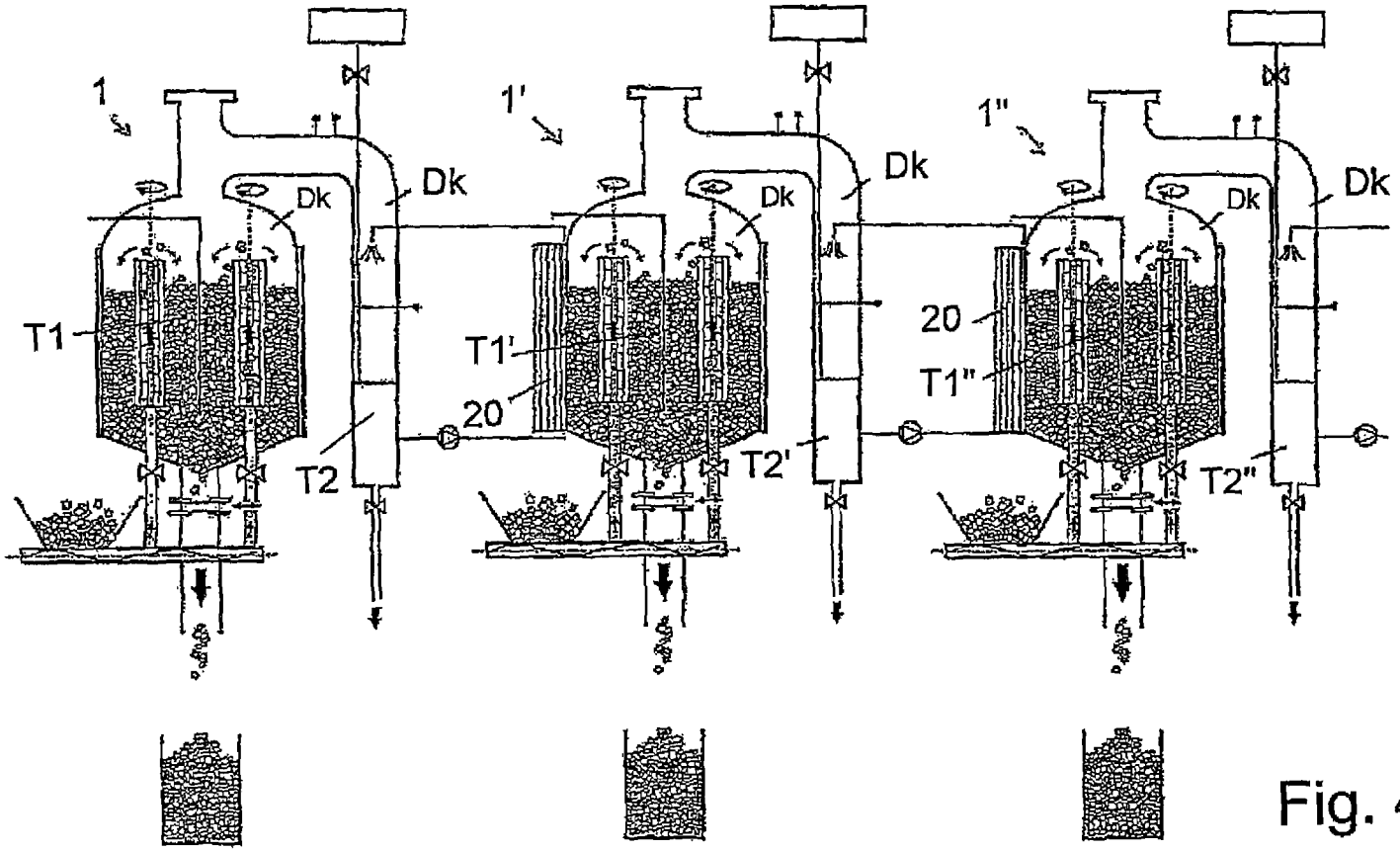
FIG. 4 shows a schematic illustration of an arrangement of several drying installations of the present invention.

As is illustrated in FIG. 4 a further improvement of the installation may be achieved by carrying out the method in two or more of such container systems 1, wherein the temperature ranges T1, T2 of the individual container systems 1 differ from each other, so that they are subsequent to each other. In a first container system 1 the method is carried out e.g. with temperatures T1=90° C. and T2=80° C., wherein a mixed temperature in the vapor chamber of e.g. 85° C. is established. In the second container system 1' the temperatures T1'=80° C. and T2'=70° C. are then adjusted, in the third container system 1" the temperatures T1"=70° C. and T2"=60° C. etc.

Preferably, the energy for adjusting the temperature of a drying container 2 or condenser 3 is attained at least in part directly or indirectly via heat exchangers from the energy of another drying container 2 or condenser 3, the temperature of which is to be altered.

In order to save energy, the release of foreign gas can be carried out by means of a vacuum jet pump, which is operated either with the condensate 5 to be sprayed from the same or a cooler stage, with vapor of another stage or with ambient air.

With such an arrangement, this may simply be achieved by arranging in each case e.g. a heat exchanger 20 between a condensate 5 and a wet material 4 of a subsequent container system 1 or a series of preceding stages, if they shall have the same temperatures. For this purpose, plate heat exchangers are preferably used.

The drying containers 2 and/or condensers 3 of the different container systems 1,1', . . . may in particular be arranged on top of each other. Particularly suitable is a horizontal arrangement of the condensers and a vertical arrangement of the drying containers. The necessary connections between single container components are in each case achieved with vapor pipes. The advantage resides in particular in the low-energy method of drying, since the energy may be used in an optimal manner. The (plate) heat exchangers used may be arranged inside or outside of the container system 1. Above all, reasons for the external arrangement are a better accessibility for cleaning the heat exchangers.

In order to keep not only the operational costs but also the purchase costs low, the container systems 1 and/or other components of the installation are preferably prepared completely or essentially from cheap plastics.

Preferably, the container system 1 has to be only resistant to excessive pressure or negative pressure, not both. This enables a cheap assembly of container system 1. For example, it can consist of a technical plastic film, which is supported at a solid frame which is arranged inside or outside of the film. There is no need for the negative pressures to be intense. For water the absolute vapor saturation pressure is still 123 mbar (relative −877 mbar) at 50° C. Therefore, the tear resistance requirement of the film is still in a range, in which the materials are available at reasonable costs.

If temperatures above 100° C. are employed, an excessive pressure in container system 1 has to be generated, to get started the drying according to the present invention. In this case the frame has to be arranged outside the film. In this case, the pressure regulator 9 is a valve which can release gas from the vapor chamber into the environment, when the pressure has to be decreased. The excessive pressure may be generated by a pump or by heating.

The container system has to be simultaneously resistant to excessive and negative pressure only if the operation takes place in a range around normal pressure, i.e. in the case of water in the range of 100° C.

Preferably, the described process is carried out in a container, in particular in an ISO container (20 or 40 feet standard container), in which the installation is accommodated and which may be a part of the installation. Such containers are cheaply available and are extremely suitable for transport and are available in tight (leakage free) embodiments. Thus, the transport from the production location to the operation location of the installation may be achieved simply and cheaply by container ship or truck. Further, this simplifies the maintenance, since if the distillation is done at a place remote from the civil population the container again can be easily brought to a maintenance place on a truck.

LIST OF REFERENCE SYMBOLS

1 container system
2 drying container
3 condenser
4 wet material
5 condensate
6 vapor chamber
7 pressure sensor
8 temperature sensor
9 regulator (pump and/or valve)
10 vapor pressure curve
11 set pressure range
12 piping
13 heating
14 cooling
15 spraying unit
16 ventilator
17 carrier, granulate
18 mixer
19 protecting panel
20 heat exchanger
21 conveying system
22 heating screw conveyor
23 conveying and locking system
24 storage container
pm mixed pressure in the vapor chamber
ps saturation vapor pressure
Tm mixed temperature in the vapor chamber
T1 temperature in the drying container
T2 temperature in the condenser
Fd liquid to be distilled
Dk vapor to be condensed
V pump and/or valve for regulating the pressure

The invention claimed is:

1. A method for drying a pasty wet material, which comprises a dry material (TS) admixed with a liquid to be distilled (Fd), using a gas-tight container system that is resistant to excess and/or negative pressure, said container system comprising a drying container with the wet material the temperature of which can be adjusted, where the liquid turns to vapor, a condenser for condensing the vapor to give a condensate as well as a vapor chamber connecting the drying container and the condenser, wherein the vapor chamber is provided with a pressure sensor for measuring a mixed pressure (pm) established therein, a temperature sensor for measuring the mixed temperature (Tm) established therein and a pressure regulator, the method including the following process steps:

a) the drying container with the wet material is brought to a first temperature (T1), and the condenser to a second lower temperature (T2);
b) the mixed pressure (pm) and the mixed temperature (Tm) are measured;
c) the saturation vapor pressure (ps) of the liquid (Fd) at the measured mixed temperature (Tm) is determined;
d) a set-pressure range is calculated, which is limited by a lower pressure limit (p1), which is at least 0.1% above the saturation vapor pressure (ps) and an upper pressure limit (p2), which is at the most 6% above the saturation vapor pressure (ps);
e) the mixed pressure (pm) is compared with a set pressure range;
f) the mixed pressure (pm) is reduced by the pressure regulator exactly until it has reached the lower pressure limit (p1);
g) the steps a) to e) are repeated, until the mixed pressure (pm) has reached the upper pressure limit (p2);
h) the steps f) and g) are repeated until the drying is to be stopped;

wherein during pressure reduction in step f) gases at the end of a condensation pathway in the condenser are sucked off to remove foreign gas from the container system as much as possible and wherein the method runs in a continuous operation.

2. The method according to claim 1, wherein at least a surface of a wet material in the drying container and/or a surface of a condensate in the condenser are/is enlarged.

3. The method according to claim 2 wherein a surface enlargement of the wet material in the drying container is achieved by the fact that the wet material is admixed under a granular carrier.

4. The method according to claim 3, wherein a carrier consists of one of the following carriers: the dry material (TS) which is contained in the pasty wet material, woodchips, plastic granulate and pebble-like stones.

5. The method according to claim 3, wherein the carrier is mixed with the wet material in a pre-heated condition.

6. The method according to claim 5, wherein the carrier is brought into the pre-heated condition in one of the inside of the drying container and outside of the drying container.

7. The method according to claim 5, wherein a heat energy introduced in the carrier corresponds to an amount of energy required for drying the wet material.

8. The method according to claim 3, wherein the carrier is mixed with the wet material in at least one conveying screw.

9. The method according to claim 1, wherein the drying container is filled in intervals and/or that a portion of the content is withdrawn from the drying container in intervals, wherein the withdrawn content is separated into dry material (TS) and carrier.

10. The method according to claim 1, wherein the entire method does not cause any odor emission.

11. The method according to claim 2, wherein the surface enlargement in the condenser is achieved by a fact that a surface-enlarging porous filling package is introduced.

12. The method according to claim 1, wherein a vapor distribution in the vapor chamber is mixed by a ventilator that is operated by one of: a sprayed mass flow of the medium to be evaporated or the condensate sprayed.

13. The method according to claim 2, wherein a release of foreign gas in step f) is done via a vacuum jet pump, which is operated either with the condensate to be sprayed of a same or a cooler stage.

14. The method according to-claim 1, wherein the method is carried out in at least two of such container systems wherein a temperature range (T1, T2) of the first container system is different from a temperature range (T1', T2') of the second container system, so that the temperature (T2) of the first container system is equal to the temperature range (T1') of the second container system.

15. The method according to claim 14, wherein an energy for heating of a drying container or condenser is obtained at least in part directly or indirectly via heat exchangers from an energy of another drying container or condenser, a temperature of which has to be altered.

16. The method according to claim 1, wherein the container system and a piping consist completely or essentially of plastics.

17. The method according to claim 1, wherein the drying container is arranged in a flooded manner in the wet material and/or the condenser is arranged in a flooded manner in the wet material or in the condensate, respectively.

18. The method according to claim 1, wherein the method is carried out in an International Standards Organization (ISO) container.

19. A method for drying a pasty wet material, which comprises a dry material (TS) admixed with a liquid to be distilled (Fd), using a gas-tight container system that is resistant to excess and/or negative pressure, said container system comprising a drying container with the wet material the temperature of which can be adjusted, where the liquid turns to vapor, a condenser for condensing the vapor to give a condensate as well as a vapor chamber connecting the drying container and the condenser, wherein the vapor chamber is provided with a pressure sensor for measuring a mixed pressure (pm) established therein, a temperature sensor for measuring the mixed temperature (Tm) established therein and a pressure regulator, the method including the following process steps:

a) the drying container with the wet material is brought to a first temperature (T1), and the condenser to a second lower temperature (T2);

b) the mixed pressure (pm) and the mixed temperature (Tm) are measured;

c) the saturation vapor pressure (ps) of the liquid (Fd) at the measured mixed temperature (Tm) is determined;

d) a set-pressure range is calculated, which is limited by a lower pressure limit (p1), which is at least 0.1% above the saturation vapor pressure (ps) and an upper pressure limit (p2), which is at the most 6% above the saturation vapor pressure (ps);

e) the mixed pressure (pm) is compared with a set pressure range;

f) the mixed pressure (pm) is reduced by the pressure regulator exactly until it has reached the lower pressure limit (p1);

g) the steps a) to e) are repeated, until the mixed pressure (pm) has reached the upper pressure limit (p2);

h) the steps f) and g) are repeated until the drying is to be stopped;

wherein during pressure reduction in step f) gases at the end of a condensation pathway in the condenser are sucked off to remove foreign gas from the container system as much as possible and wherein the drying container is filled in intervals and/or that a portion of the content is withdrawn from the drying container in intervals.

20. The method according to claim 19, wherein at least a surface of a wet material in the drying container and/or a surface of a condensate in the condenser are/is enlarged.

21. The method according to claim 20 wherein a surface enlargement of the wet material in the drying container is achieved by the fact that the wet material is admixed under a granular carrier.

22. The method according to claim 3, wherein a carrier consists of one of the following carriers: the dry material (TS) which is contained in the pasty wet material, woodchips, plastic granulate and pebble-like stones.

23. The method according to claim 21, wherein the carrier is mixed with the wet material in a pre-heated condition.

24. The method according to claim 23, wherein the carrier is brought into the pre-heated condition in one of the inside of the drying container and outside of the drying container.

25. The method according to claim 23, wherein a heat energy introduced in the carrier corresponds to an amount of energy required for drying the wet material.

26. The method according to claim 21, wherein the carrier is mixed with the wet material in at least one conveying screw.

27. The method according to claim 19, wherein the method runs in a continuous operation.

28. The method according to claim 19, wherein the withdrawn content is separated into dry material (TS) and carrier.

29. The method according to claim 19, wherein the entire method does not cause any odor emission.

30. The method according to claim 20, wherein the surface enlargement in the condenser is achieved by a fact that a surface-enlarging porous filling package is introduced.

31. The method according to claim 19, wherein a vapor distribution in the vapor chamber is mixed by a ventilator that is operated by one of: a sprayed mass flow of the medium to be evaporated or the condensate sprayed.

32. The method according to claim 20, wherein a release of foreign gas in step f) is done via a vacuum jet pump, which is operated either with the condensate to be sprayed of a same or a cooler stage.

33. The method according to-claim 19, wherein the method is carried out in at least two of such container systems wherein a temperature range (T1, T2) of the first container system is different from a temperature range (T1', T2') of the second container system, so that the temperature (T2) of the first container system is equal to the temperature range (T1') of the second container system.

34. The method according to claim 33, wherein an energy for heating of a drying container or condenser is obtained at least in part directly or indirectly via heat exchangers from an energy of another drying container or condenser, a temperature of which has to be altered.

35. The method according to claim 19, wherein the container system and a piping consist completely or essentially of plastics.

36. The method according to claim 19, wherein the drying container is arranged in a flooded manner in the wet material and/or the condenser is arranged in a flooded manner in the wet material or in the condensate, respectively.

37. The method according to claim 19, wherein the method is carried out in an International Standards Organization (ISO) container.

* * * * *